United States Patent [19]

Nishijima et al.

[11] Patent Number: 4,954,431

[45] Date of Patent: Sep. 4, 1990

[54] SILVER HALIDE PHOTOGRAPHIC LIGHT-SENSITIVE MATERIAL

[75] Inventors: Toyoki Nishijima; Masaki Tanji, both of Odawara, Japan

[73] Assignee: Konica Corporation, Tokyo, Japan

[21] Appl. No.: 370,814

[22] Filed: Jun. 23, 1989

[30] Foreign Application Priority Data

Jul. 6, 1988 [JP] Japan ..... 63-166895

[51] Int. Cl.[5] ..... G03C 7/38

[52] U.S. Cl. ..... 430/546; 430/551; 430/554; 430/555

[58] Field of Search ..... 430/551, 554, 555, 546

[56] References Cited

U.S. PATENT DOCUMENTS

| | | | |
|---|---|---|---|
| 3,930,866 | 1/1976 | Oishi et al. | 430/551 |
| 4,070,191 | 1/1978 | Imamura et al. | 430/555 |
| 4,661,441 | 4/1987 | Kajiwata et al. | 430/555 |
| 4,839,263 | 6/1989 | Miyoshi et al. | 430/551 |

FOREIGN PATENT DOCUMENTS

| | | |
|---|---|---|
| 255783 | 2/1988 | European Pat. Off. . |
| 3605713 | 8/1987 | Fed. Rep. of Germany . |

OTHER PUBLICATIONS

Research Disclosure No. 144, Apr. 1976, pp. 39, 40, Havant, Hampshire, GB; disclosure No. 14436, "Farbphotographisches Material", no translation.

*Primary Examiner*—Richard L. Schilling
*Attorney, Agent, or Firm*—Jordan B. Bierman

[57] ABSTRACT

A silver halide photographic material containing a specific magenta coupler and a heterocyclic mercapto compound is disclosed. The photographic material is raised in its resistivity to magenta fogging caused by contamination of developer with bleaching solution, without degradation of color reproducibility. The photographic material is comprised of a support having thereon a silver halide emulsion layer and a non-light-sensitive layer and the emulsion layer contains a magenta coupler represented by the following Formula I and at least one of the emulsion layer and the non-light-sensitive layer contains a compound represented by the following formula S.

(I)

(S)

15 Claims, No Drawings

SILVER HALIDE PHOTOGRAPHIC LIGHT-SENSITIVE MATERIAL

FIELD OF THE INVENTION

The present invention relates to a silver halide photographic light-sensitive material.

BACKGROUND OF THE INVENTION

As having been hitherto well known, a color image is formed by subjecting a silver halide photographic light-sensitive material to imagewise exposure and color development, where an oxidized product of an aromatic primary amine color developing agent couples with a color-forming coupler to produce, for example, indophenol, indoaniline, indamine, azomethine, phenoxazine, phenazine, or a dye analogous to any of these, thus forming a color image. In such a photographic system, color reproduction is usually carried out by a subtractive color process, and there is used a silver halide photographic light-sensitive material comprising blue-sensitive, green-sensitive and red-sensitive silver halide photographic light-sensitive emulsion layers, respectively incorporated with color-forming couplers having complementary color relations to each other, i.e., couplers capable of respectively forming yellow, magenta and cyan dyes.

Of the above, the coupler used to form a yellow color image includes, for example, acylacetanilide couplers. The coupler for forming a magenta color image is known to be exemplified by pyrazolone, pyrazolobenzimidazole, pyrazolotriazole or indazolone couplers, and commonly used as the coupler for forming a cyan color image are, for example, phenol or naphthol couplers.

In general, silver halide photographic light-sensitive materials are continuously processed in various photofinishing laboratories called labs or so while replenishing processing solutions, during which, however, it is impossible to keep constant the composition of the processing solutions at the initial stage and latter half of the continuous processing, and there arises the problem that the compositional changes of processing solutions bring about the variations of photographic performance.

This problem is growing serious with the recent tendency that the processing solutions are replenished in less amounts.

In particular, it is almost impossible to prevent a bleaching solution from being included into a developing solution, or strictly set the replenishing rate of replenishing solutions or perfectly prevent evaporation thereof. Particularly in roller carriage type automatic processing machines, the quantity of the bleaching solution included into the developing solution greatly differs depending on the quantity of processing or manner of squeegeeing, and the speed of revolution of processing solutions changes as the replenishing rate of processing solutions changes, so that in actual circumstances a greater difference is produced.

When such variations occur in color developing solutions, particularly questioned is the generation of fog.

Particularly when in the processing with automatic processing machines the replenishing rate of the processing solutions has substantially increased, there is the problem that the generation of fog is caused in magenta color images.

A fog restrainer must be used in a large quantity to prevent this problem with ease. This, however, may causes new problem that developing performance and desilvering performance are worsened, and hence it is difficult to practically use the fog restrainer in a large quantity.

On the other hand, a measure may be taken to use a magenta coupler that may cause the generation of fog with difficulty. This, however, has involved the problem that the tone of magenta color images obtained by such a coupler tends to be made to have a short wave.

Accordingly, it has been sought to propose a silver halide photographic light-sensitive material that can be free of any deterioration of the tone of magenta color images and may not cause the generation of magenta fog that may be caused when the bleaching solution is included into the developing solution during the continuous operation of continuous processing.

SUMMARY OF THE INVENTION

A first object of the present invention is to provide a silver halide photographic light-sensitive material that prevents generation of the magenta fog caused when the bleaching solution is included into the developing solution.

A second object of the present invention is to provide a silver halide photographic light-sensitive material that prevents generation of the magenta fog without deteriorating the tone of magenta images.

Then the present inventors made various studies, and as a result found that the above objects can be achieved by using a magenta coupler having a specific structure, in combination with a specific fog restrainer, thus accomplishing the present invention.

The objects of the present invention can be achieved by a silver halide photographic light-sensitive material, comprising a support and provided thereon a silver halide emulsion layer and a non-light-sensitive layer, wherein the silver halide emulsion layer contains at least one of the magenta couplers represented by the following Formula I, and at least one of said silver halide emulsion layer and non-light-sensitive layer contains at least one of the compounds represented by the following Formula S.

Formula I

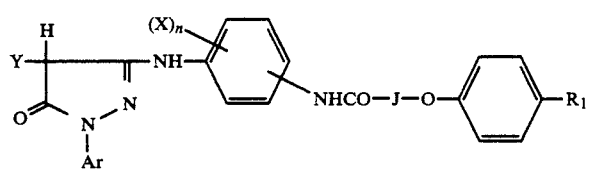

wherein Ar represents an aryl group; Y represents a hydrogen atom or a group capable of being split off upon reaction with an oxidized product of a color developing agent; X represents a halogen atom, an alkoxy group or an alkyl group; $R_1$ represents a straight-chain or branched alkyl group having 1 to 20 carbon atoms; J represents a straight-chain or branched alkylene group; and n represents an integer of 0 to 4; provided that the groups represented by X may be the same or different from each other when n is two or more.

Formula S

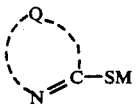

wherein Q represents a group of atoms necessary to complete a heterocyclic ring of 5 or 6 members which may be condensed with a benzene or naphthalene ring; and M represents a hydrogen atom, an alkali metal atom or an ammonium group.

DETAILED DESCRIPTION OF THE INVENTION

In Formula I, Ar represents an aryl group, and preferably a phenyl group having a substituent. The substituent preferably includes a halogen atom as exemplified by fluorine, chlorine or bromine, an alkyl group as exemplified by methyl, ethyl or butyl, an alkoxy group as exemplified by methoxy or ethoxy, an aryloxy group as exemplified by phenoxy or naphthoxy, an acylamino group as exemplified by α-(2,4-di-t-amylphenoxy)-butylamido or benzamido, a sulfonyl amino group as exemplified by hexadecanesulfonamido or benzenesulfonamido, a sulfamoyl group as exemplified by methylsulfamoyl or phenylsulfamoyl, a carbamoyl group as exemplified by butylcarbamoyl or phenylcarbamoyl, a sulfonyl group as exemplified by methylsulfonyl, dodecylsulfonyl or benzenesulfonyl, an acyloxy group, an ester group, a carboxyl group, a sulfo group, a cyano group, and a nitro group.

The group represented by Y, capable of being split off upon reaction of an oxidized product of a color developing agent, includes, for example, a halogen atom such as a chlorine, bromine or fluorine atom, an alkoxy group, an aryloxy group, a heterocyclic oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic thio group, an alkyloxythio group, a carbonylthio group, an acylamino group, a sulfonamido group, a nitrogen-containing heterocyclic ring combined with a nitrogen atom, an alkyloxycarbonylamino group, and an aryloxycarbonylamino group.

X represents a halogen atom as exemplified by a chlorine, bromine or fluorine atom, an alkoxy group as exemplified by a methoxy group, an ethoxy group or a butoxy group, or alkyl group as exemplified by a methyl group, an ethyl group, an iso-propyl group, a n-butyl group or a n-hexyl group, and n represents an integer of 0 to 4, provided that X's may be the same or different when n is two or more.

$R_1$ represents a straight-chain or branched alkyl group having 1 to 20 carbon atoms.

The above alkyl group includes, for example, a methyl group, a t-butyl group, a t-amyl group, a t-octyl group, a nonyl group, and a dodecyl group.

J represents a straight-chain or branched alkylene group, preferably a methylene group (which may have an alkyl substituent) or a trimethylene group (which may have an alkyl substituent), more preferably a methylene group, and particularly preferably a methylene group having an alkyl substituent having 1 to 20 carbon atoms, as exemplified by a n-hexyl-methylene group, a n-octylmethylene group or a n-dodecyl-methylene group. Of these, most preferred is a methylene group having an alkyl substituent having 1 to 4 carbon atoms, as exemplified by a methyl-methylene group, an ethylmethylene group, a n-propyl-methylene group, an i-propyl-methylene group or an n-butyl-methylene group.

Typical examples of the magenta coupler represented by Formula I are shown below, but the magenta coupler represented by Formula I is by no means limited to these.

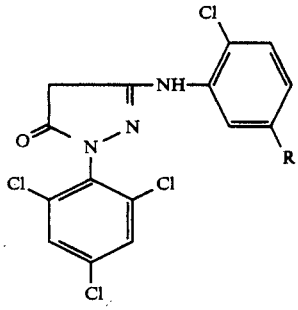

| No. | R |
|---|---|
| M-1 | 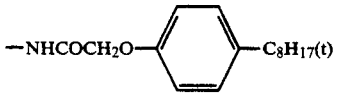 |
| M-2 | 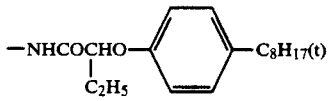 |

-continued
M-3
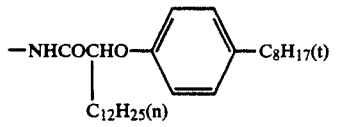
M-4
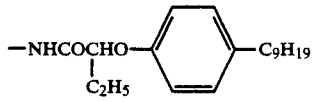
M-5
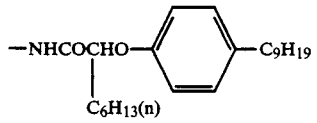
M-6
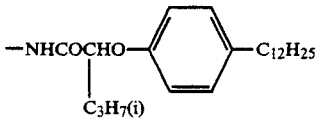
M-7
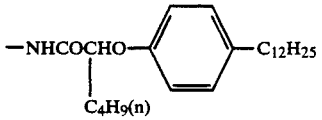
M-8
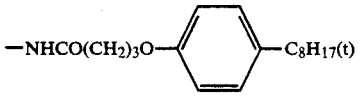
M-9
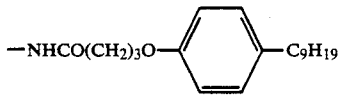
M-10
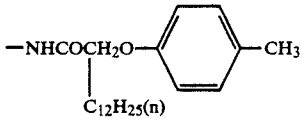
M-11
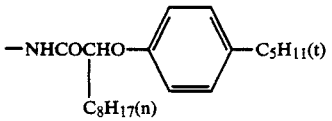
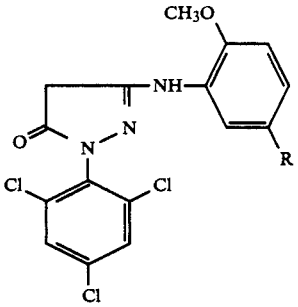
M-12
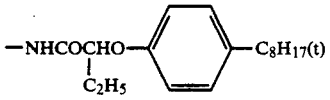

-continued
M-13
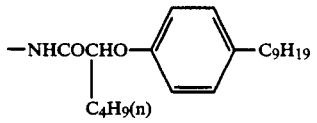
M-14
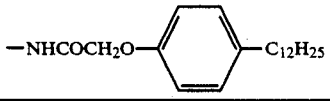
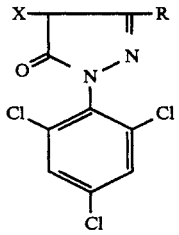
| No. | X | R |
|---|---|---|
| M-15 | H— | 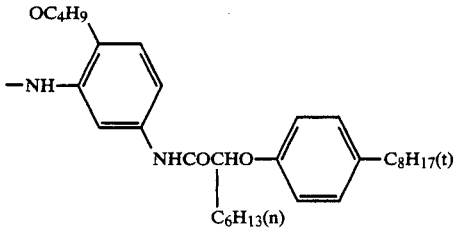 |
| M-16 | 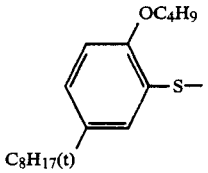 | 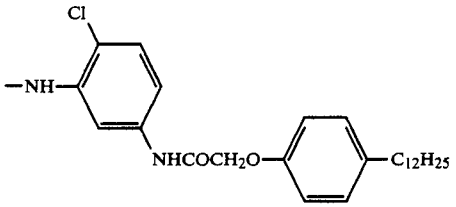 |
| M-17 | H— | 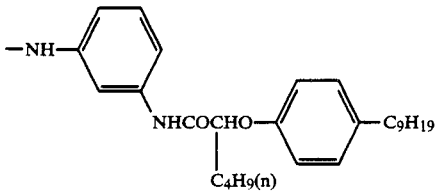 |
| M-18 | 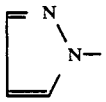 | 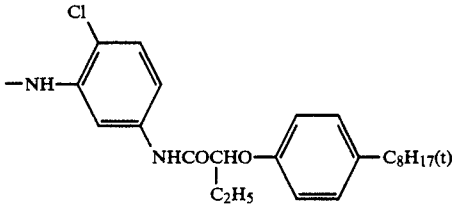 |
| M-19 | H— | 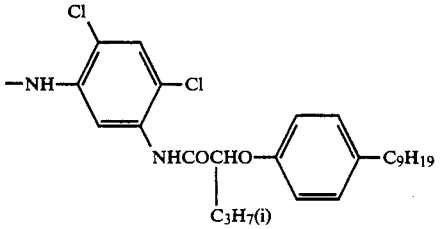 |

-continued
M-20
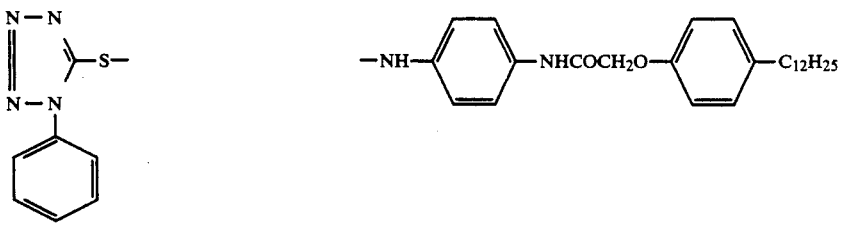
M-21
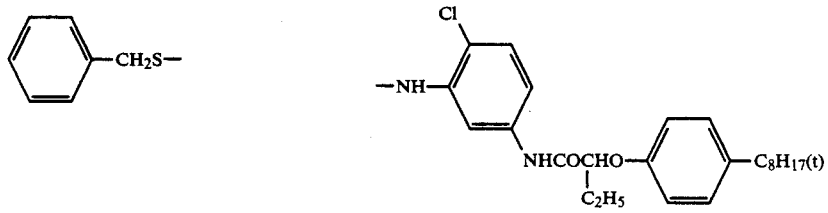
M-22 $CF_3CONH$—
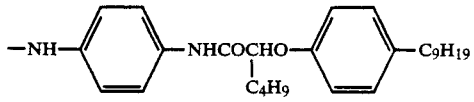
M-23
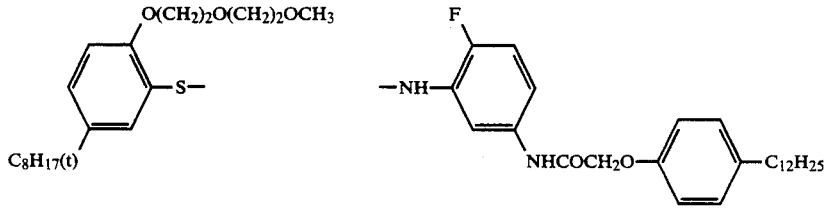
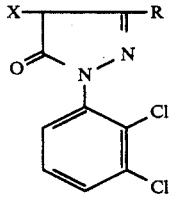
M-24 H—
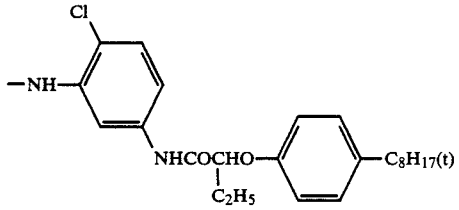
M-25
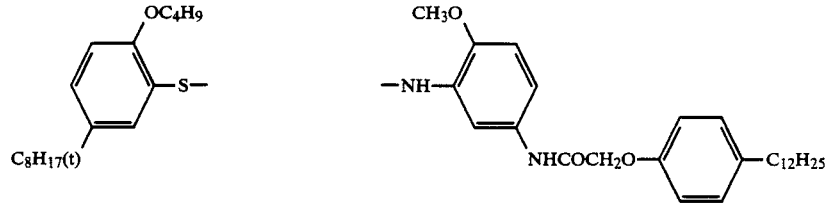
M-26 H—
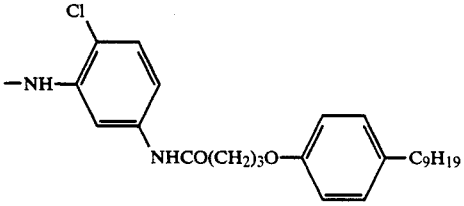

-continued
M-27
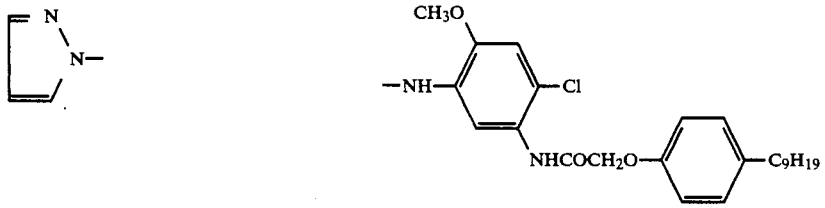
M-28 H—
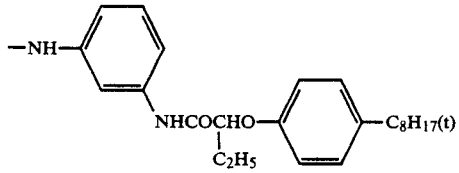
M-29 $CH_3CO_2$—
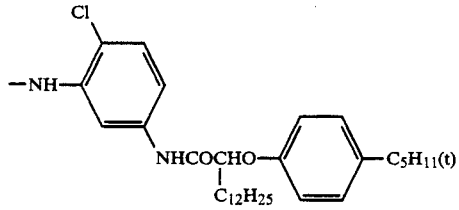
M-30
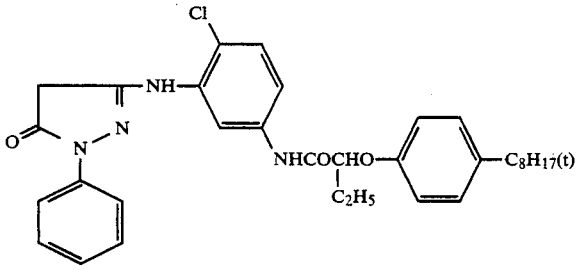
M-31
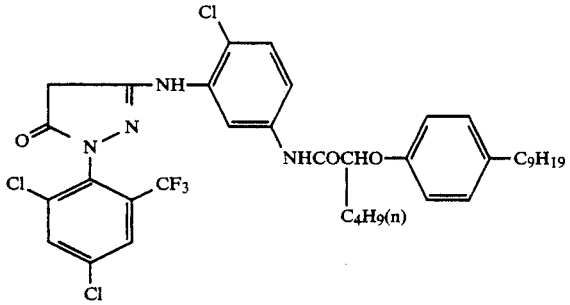
M-32
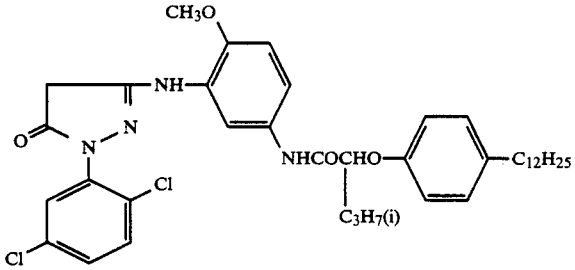

-continued

M-33

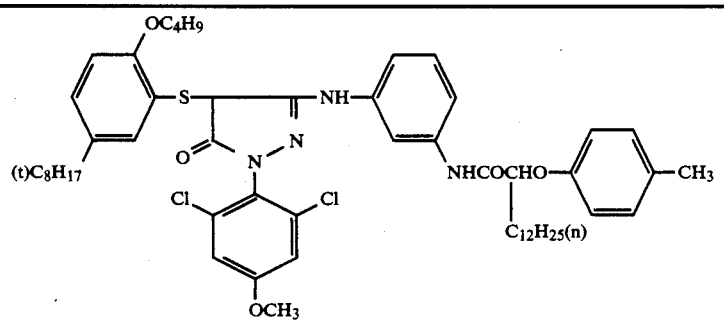

M-34

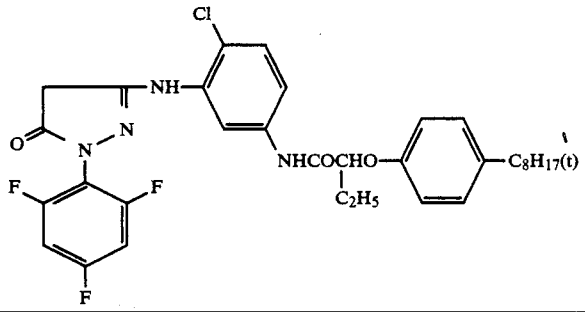

The magenta coupler according to the present invention can be used in an amount ranging usually from $1\times10^{-3}$ mol to 1 mol, and preferably from $1\times10^{-2}$ to $8\times10^{-1}$ mol, per mol of silver halide.

The compound represented by Formula S, used in the silver halide photographic light-sensitive material of the present invention, will be described below.

Formula S

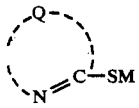

The heterocyclic ring which is formed by Q and may be condensed with a benzene or naphthalene ring includes imidazole, tetrazole, thiazole, oxazole, selenazole, benzimidazole, naphthoimidazole, benzothiazole, naphtothiazole, benzoselenazole, naphthoselenazole, benzoxazole, pyridine, pyrimidine, and quinoline. These heterocyclic rings include those having a substituent. M is a hydrogen atom, an alkali metal atom or an ammonium group.

Typical examples of the compound represented by Formula S are shown below.

S-1

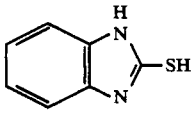

S-2

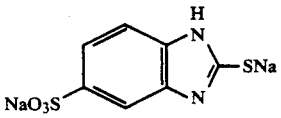

S-3

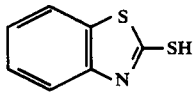

-continued

S-4

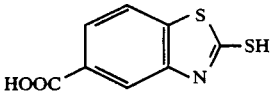

S-5

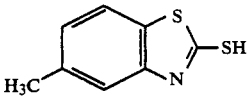

S-6

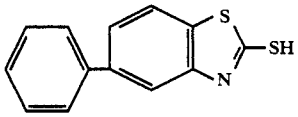

S-7

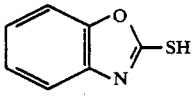

S-8

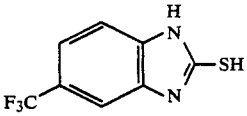

S-9

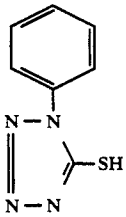

-continued

S-10

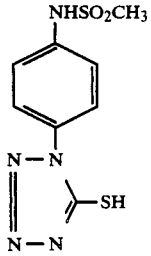

S-11

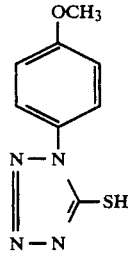

S-12

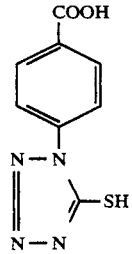

S-13

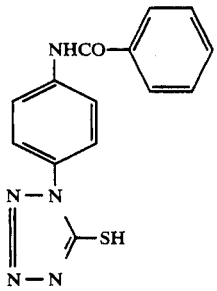

S-14

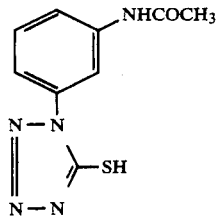

S-15

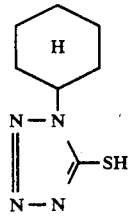

S-16

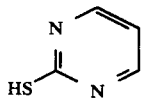

-continued

S-17

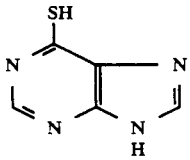

S-18

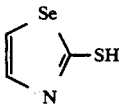

S-19

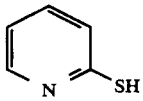

S-20

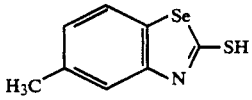

S-21

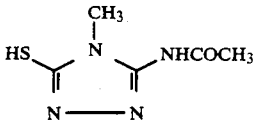

In incorporating the compound of Formula S into the silver halide emulsion layer, the compound of Formula S may preferably be added in the course of chemical ripening of emulsions, at the time the chemical ripening is completed, or in the time of later than completion of the chemical ripening and not later than coating. It may be added in its whole amount at a time, or may be dividedly added at several times.

The compound of Formula S is used in an amount ranging usually from $1\times10^{-6}$ mol to $1\times10^{-1}$ mol, and preferably from $1\times10^{-5}$ mol to $1\times10^{-2}$ mol, per mol of silver halide.

Dye forming couplers used in the silver halide photographic light-sensitive material of the present invention may all preferably have in their molecules a group having 8 or more carbon atoms, called a ballast group capable of making non-diffusible a coupler.

Yellow dye forming couplers that can be preferably used include acylacetoanilide couplers. Of these, advantageous are benzoylacetoanilide and pivaloylacetonitrile compounds.

Examples of usable yellow couplers are those disclosed in British Patent No. 1,077,874, Japanese Patent Examined Publication No. 40757/1970, Japanese Patent Publications Open to Public Inspection (hereinafter referred to as Japanese Patent O.P.I. Publication Nos.) 1031/1972, 26133/1972, 94432/1973, 87650/1975, 3631/1976, 115219/1977, 99433/1979, 133329/1979 and 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752.

Cyan dye forming couplers that may be used include phenol or naphthol type cyan dye forming couplers, and Specific examples are disclosed in U.S. Pat. Nos.

2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, and 3,839,044, British Patent Nos. 478,991, 945,542, 1,084,480, 1,337,233, 1,388,024 and 1,543,040, Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984 and 117249/1985, etc.

The dye forming couplers used in the present invention may each be used in an amount ranging usually from $1\times10^{-3}$ mol to 1 mol, and preferably from $1\times10^{-2}$ mol to $8\times10^{-1}$ mol, per mol of silver halide in the respective silver halide emulsion layers.

The above dye forming couplers may be added in the intended hydrophilic colloid layer after dissolving a coupler in a high-boiling organic solvent boiling at about 150° C. or more, optionally using a low-boiling and/or water-soluble organic solvent in combination, and dispersing the resulting solution by emulsification in a hydrophilic binder such as an aqueous gelatin solution by using a surface active agent. A step may be added to remove the low-boiling organic solvent from the dispersion or at the same time with dispersing.

The high-boiling organic solvent used in the present invention may preferably include compounds having a dielectric constant of not more than 6.5, as exemplified by esters such as phthalate and phosphate, organic amides, ketones and hydrocarbon compounds having a dielectric constant of not more than 6.5. More preferably it includes high-boiling organic solvents having a dielectric constant of not more than 6.5 and not less than 1.9, and a vapor pressure of 0.5 mmHg at 100° C. Of these, it still more preferably includes phthalic esters or phosphoric esters. Most preferably it includes dialkylphthalate having an alkyl group having 9 or more carbon atoms. The high-boiling organic solvent may further be comprised of a mixture of two or more kinds.

The dielectric constant herein refers to a dielectric constant at 30° C.

These high-boiling organic solvents are used in a proportion generally of from 0 to 400% by weight based on the couplers, and preferably from 10 to 100% by weight based on the couplers.

The silver halide that can be used includes any silver halides used in usual silver halide photographic light-sensitive materials, as exemplified by silver chloride, silver bromide, silver iodide, silver chlorobromide, silver iodobromide and silver chloroiodobromide. It, however, may preferably include silver chlorobromide, more preferably silver chlorobromide having a silver chloride content of not less than 90 mol %, and particularly preferably silver chlorobromide having a silver chloride content of not less than 99 mol %.

The silver halide photographic light-sensitive material used in the present invention may, for example, include color negative or positive films and color photographic papers, but the effect of the present invention can be effectively exhibited particularly when color photographic paper for use in direct viewing is used.

The silver halide photographic light-sensitive material of the present invention, including the color photographic paper, may be those for use in monochromes or those for use in multicolors. In the instance of silver halide photographic light-sensitive materials for use in multicolors, they usually have a structure that the silver halide emulsion layers respectively containing magenta, yellow and cyan couplers and non-light-sensitive layers are laminated on a support in appropriate numbers and order so that the subtractive color reproduction can be carried out. The numbers and order of the layers, however, may be appropriately altered depending on what performance is emphasized and what purpose the photographic materials are used for.

In the instance where the silver halide photographic light-sensitive material used in the present invention is the multicolor photographic material, it may particularly preferably comprise, as a specific layer constitution, a support and provided thereon with a yellow dye image forming layer, an intermediate layer, a magenta dye image forming layer, an intermediate layer, a cyan dye image forming layer, an intermediate layer, and a protective layer, in this order.

As binders or protective colloids used in the silver halide photographic light-sensitive material of the present invention, it is advantageous to use gelatin, but, besides, it is also possible to use hydrophilic colloids including synthetic hydrophilic polymeric substances such as gelatin derivatives, graft polymers of gelatin with other macromolecules, proteins, sucrose derivatives, and cellulose derivatives, homopolymers or copolymers.

The photographic emulsion layers and other hydrophilic colloid layers of the silver halide photographic light-sensitive material of the present invention are hardened by using hardening agents that cross-link molecules of the binder or protective colloids and enhance film strength, which may be used alone or in combination. The hardening agent should preferably be added in such an amount that no hardening agent may not be added in processing solutions and the light-sensitive material can be hardened. It, however, is also possible to add the hardening agent in the processing solutions.

The hydrophilic colloid layers such as protective layers and intermediate layers of the silver halide photographic light-sensitive material of the present invention may contain an ultraviolet absorbent for the purpose of preventing the fogging due to the electrical discharge caused by electrostatic charging of the light-sensitive material by friction or the like, and preventing images from being deteriorated by ultraviolet light.

The silver halide photographic light-sensitive material of the present invention may be provided with an auxiliary layer or layers such as a filter layer, an antihalation layer and/or an anti-irradiation layer. These layers and/or emulsion layers may also be incorporated with a dye capable of being flowed out from the color light-sensitive material or bleached in the course of development processing.

A matting agent may be added in the silver halide emulsion layers and/or other hydrophilic colloid layers, with aims at decreasing the gloss of the light-sensitive material, increasing inscribability, and preventing mutual sticking between light-sensitive materials.

A lubricant may be added in the silver halide photographic light-sensitive material of the present invention to decrease sliding friction.

An antistatic agent may be added in the silver halide photographic light-sensitive material of the present invention for the purpose of preventing the light-sensitive material from being electrostatically charged. The antistatic agent is often used in an antistatic layer on the side of a support on which the emulsion layers are not laminated, or may be used in the emulsion layers or the protective colloid layer other than the emulsion layers, on the side of a support on which the emulsion layers are laminated.

Various surface active agents are used in the photographic emulsion layers and/or other hydrophilic colloid layers of the silver halide photographic light-sensitive material of the present invention for the purposes of improving coating properties, preventing electrostatic charging, improving lubricity, facilitating emulsification dispersion, preventing adhesion, and improving photographic performance (for example, accelerating development, making tone harder or enhancing speed).

The photographic emulsion layers and/or other hydrophilic colloid layers of the silver halide photographic light-sensitive material of the present invention can be provided by coating on a flexible reflective support such as baryta paper or paper laminated with an α-olefin polymer, and a synthetic paper; a film comprising a semi-synthetic or synthetic polymers such as cellulose acetate, cellulose nitrate, polystyrene, polyvinyl chloride, polyethylene terephthalate, polycarbonate or polyamide; and a rigid body such as a glass, a metal or a ceramic.

The silver halide photographic light-sensitive material of the present invention may be optionally applied on the surface of the support with corona discharging, ultraviolet irradiation or flame treating, and thereafter may be provided with the photographic emulsion layers and/or other hydrophilic colloid layers by coating, directly or through a subbing layer (one or more of subbing layer(s) for improving adhesion, antistatic properties, dimensional stability, wear resistance, hardness, anti-halation properties, frictional characteristics and/or other characteristics on the surface of the support.

In providing the photographic emulsion layers and/or other hydrophilic colloid layers of the silver halide photographic light-sensitive material by coating, in which the silver halide emulsion of the present invention is used, a thickening agent may be used so that the coating performance can be improved. Particularly useful as coating methods are extrusion coating and curtain coating, which can afford to simultaneously carry out coating of two or more layers.

In the present invention, the color developing agent used in a color developing solution includes known agents widely used in various color photographic processes.

In the present invention, the light-sensitive material is processed with a processing solution having a bleaching ability, immediately after color developing. The solution having the bleaching ability, however, may be a processing solution also having a fixing ability (i.e., so-called bleach-fixing solution).

A metal complex salt of an organic acid is preferably used as a bleaching agent used in the bleaching step.

EXAMPLES

The present invention will be described below in greater detail by giving Examples.

EXAMPLE 1

On a support comprising a paper support, on one surface of which a polyethylene film was laminated and on the first layer side on the other surface of which a polyethylene film containing titanium oxide was laminated, the respective layers constituted as shown in Table 1 were provided by coating to prepare a multilayer silver halide photographic light-sensitive material Sample 1. Coating solutions were prepared in the following ways.

Third-layer coating solution:

To 35 g of a magenta coupler (MA), 10 g of a dye image stabilizer (ST-3), 6.7 g of a dye image stabilizer (ST-4), 1.0 g of an anti-stain agent (HQ-1) and 30 g of a high-boiling organic solvent (DIDP), 60 ml of ethyl acetate was added to effect dissolution. The resulting solution was dispersed by emulsification in 200 ml of an aqueous 10% gelatin solution with use of an ultrasonic homogenizer to prepare a magenta coupler dispersion.

This dispersion was mixed with a green-sensitive silver halide emulsion (containing 27 g of silver) prepared under conditions shown below to prepare a third-layer coating solution.

Coating solutions for other layers were also prepared in the same manner as the above third-layer coating solution.

The following H-1 and H-2 were used as hardening agents.

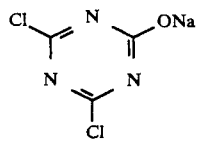

H-1

$C(CH_2SO_2CH{=}CH_2)_4$ H-2

Preparation of blue-sensitive silver halide emulsion:

In 1,000 ml of an aqueous 2% gelatin solution kept at a temperature of 40° C., the following Solution A and Solution B were simultaneously added taking a time of 30 minutes while controlling the mixture to be pAg=6.5 and pH=3.0, and the following Solution C and Solution D were further simultaneously added taking a time of 180 minutes while controlling the mixture to be pAg=7.3 and pH=5.5.

Here, the pAg was controlled following the procedures as described in Japanese Patent O.P.I. Publication No. 45437/1984, and the pH was controlled using an aqueous solution of sulfuric acid or sodium hydroxide.

| | |
|---|---|
| Solution A: | |
| NaCl | 3.42 g |
| KBr | 0.03 g |
| By adding $H_2O$, made up to | 200 ml |
| Solution B: | |
| $AgNO_3$ | 10 g |
| By adding $H_2O$, made up to | 200 ml |
| Solution C: | |
| NaCl | 102.7 g |
| KBr | 1.0 g |
| By adding $H_2O$, made up to | 600 ml |
| Solution D: | |
| $AgNO_3$ | 300 g |
| By adding $H_2O$, made up to | 600 ml |

After the addition was completed, desalting was carried out using an aqueous 5% solution of Demole N, a product of Kao Atras Co, and an aqueous 20% solution of magnesium sulfate, and thereafter the mixture was mixed with an aqueous gelatin solution, to obtain a monodisperse cubic emulsion EMP-1 with an average grain size of 0.85 μm, a variation coefficient of $(\sigma/\bar{r})=0.07$ and a silver chloride content of 99.5 mol %.

The above emulsion EMP-1 was subjected to chemical ripening at 50° C. for 90 minutes using the following compounds, to obtain a blue-sensitive silver halide emulsion EmA.

| | |
|---|---|
| Sodium thiosulfate | 0.8 mg/mol AgX |
| Chloroauric acid | 0.5 mg/mol AgX |
| Stabilizer SB-1 | $6 \times 10^{-4}$/mol AgX |
| Sensitizing dye D-1 | $5 \times 10^{-4}$/mol AgX |

Preparation of green-sensitive silver halide emulsion:

Procedures for preparing EMP-1 were repeated but varying the time for adding Solution A and Solution B and the time for adding Solution C and Solution D, to obtain a monodisperse cubic emulsion EMP-2 with an average grain size of 0.43 μm, a variation coefficient of $(\sigma/\bar{r})=0.08$ and a silver chloride content of 99.5 mol %.

The above emulsion EMP-2 was subjected to chemical ripening at 55° C. for 120 minutes using the following compounds, to obtain a green-sensitive silver halide emulsion EmB.

| | |
|---|---|
| Sodium thiosulfate | 1.5 mg/mol AgX |
| Chloroauric acid | 1.0 mg/mol AgX |
| Stabilizer SB-1 | $6 \times 10^{-4}$/mol AgX |
| Sensitizing dye D-2 | $4.0 \times 10^{-4}$/mol AgX |

Preparation of red-sensitive silver halide emulsion:

Procedures for preparing EMP-1 were repeated but varying the time for adding Solution A and Solution B and the time for adding Solution C and Solution D, to obtain a monodisperse cubic emulsion EMP-2 with an average grain size of 0.50 μm, a variation coefficient of $(\sigma/\bar{r})=0.08$ and a silver chloride content of 99.5 mol %.

The above emulsion EMP-2 was subjected to chemical ripening at 60° C. for 90 minutes using the following compounds, to obtain a red-sensitive silver halide emulsion EmC.

| | |
|---|---|
| Sodium thiosulfate | 1.8 mg/mol AgX |
| Chloroauric acid | 2.0 mg/mol AgX |
| Stabilizer SB-1 | $6 \times 10^{-4}$/mol AgX |
| Sensitizing dye D-3 | $8.0 \times 10^{-4}$/mol AgX |

D-1

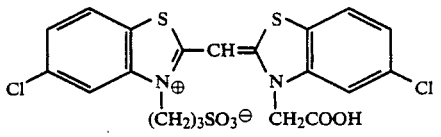

D-2

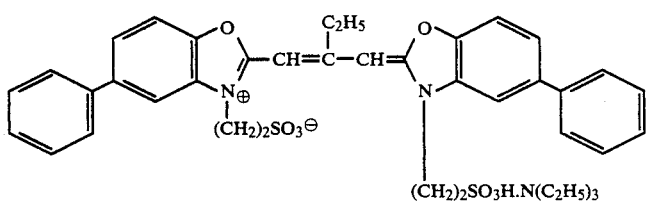

D-3

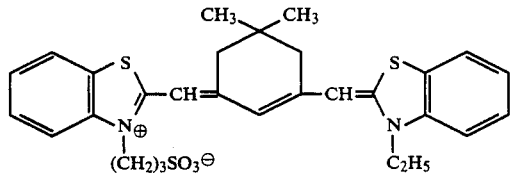

SB-1

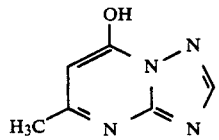

TABLE 1

| Layer | Constitution | Amount ($g/m^2$) |
|---|---|---|
| Seventh layer (Protective layer) | Gelatin | 1.0 |
| Sixth layer | Gelatin | 0.6 |
| | Color-mix preventing agent (HQ-1) | 0.01 |
| | DNP | 0.2 |
| | PVP | 0.03 |
| | Anti-irradiation dye (AI-2) | 0.02 |
| | Ultraviolet absorbent (UV-1) | 0.2 |
| | Ultraviolet absorbent (UV-2) | 0.1 |
| Fifth layer (Red-sensitive layer) | Gelatin | 1.40 |
| | Red-sensitive silver halide emulsion (EmC), in terms of silver | 0.24 |
| | Cyan coupler (C-1) | 0.17 |

TABLE 1-continued

| Layer | Constitution | Amount ($g/m^2$) |
|---|---|---|
| | Cyan coupler (C-2) | 0.25 |
| | Dye image stabilizer (ST-1) | 0.20 |
| | High-boiling organic solvent (HB-1) | 0.10 |
| | Anti-stain agent (HQ-1) | 0.01 |
| | DOP | 0.30 |
| Fourth layer | Gelatin | 1.30 |
| | Anti-stain agent (HQ-1) | 0.03 |
| | DNP | 0.40 |
| | Ultraviolet absorbent (UV-1) | 0.6 |
| | Ultraviolet absorbent (UV-2) | 0.2 |
| Third layer (Green-sensitive layer) | Gelatin | 1.40 |
| | Green-sensitive silver halide emulsion (EmB), in terms of silver | 0.27 |
| | Magenta coupler (MA) | 0.35 |
| | Dye image stabilizer (ST-3) | 0.10 |
| | Dye image stabilizer (ST-4) | 0.067 |
| | Anti-stain agent (HQ-1) | 0.01 |
| | DIDP | 0.30 |
| | Anti-irradiation dye (AI-1) | 0.01 |
| Second layer (Intermediate layer) | Gelatin | 1.20 |
| | Anit-stain agent (HQ-1) | 0.12 |
| | Diaminostilbene brightening agent | 0.10 |
| | DIDP | 0.15 |
| First layer (Blue-sensitive layer) | Gelatin | 1.30 |
| | Blue-sensitive silver halide emulsion (EmA), in terms of silver | 0.30 |
| | Yellow coupler (Y-1) | 0.80 |
| | Dye image stabilizer (ST-1) | 0.30 |
| | Dye image stabilizer (ST-2) | 0.20 |
| | Anti-stain agent (HQ-1) | 0.02 |
| | DNP | 0.20 |
| Support | Polyethylene laminated paper | |

Y-1

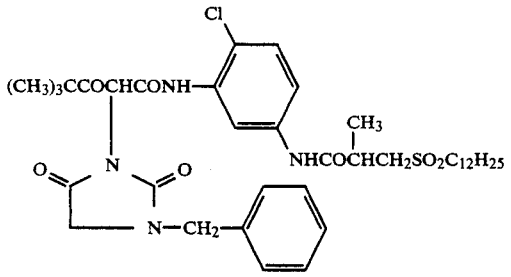

MA

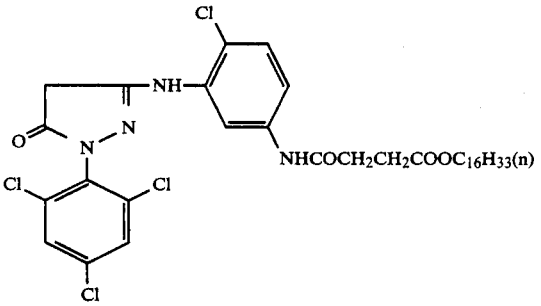

C-1

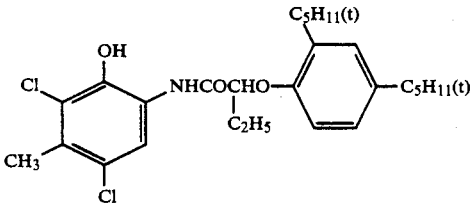

TABLE 1-continued
| Layer | Constitution | Amount ($g/m^2$) |
|---|---|---|
| C-2 | 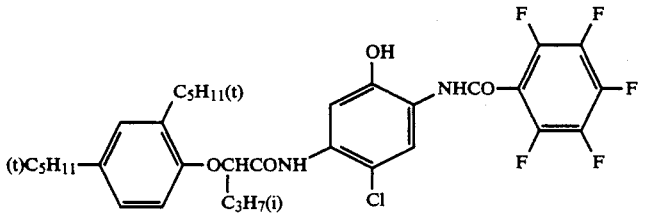 | |
| ST-1 | 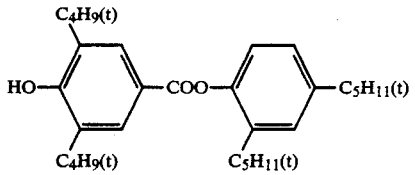 | |
| ST-2 | 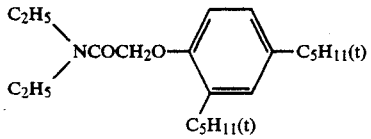 | |
| | DOP: Diocytlphthalate<br>DNP: Dinonylphthalate<br>DIDP: Diisodecylphthalate<br>PVP: Polyvinyl pyrrolidone | |
| HQ-1 | 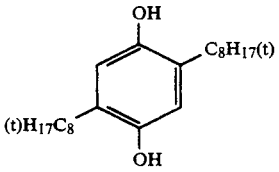 | |
| ST-3 | 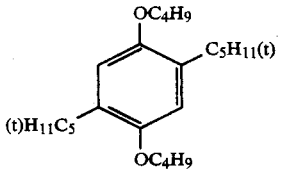 | |
| ST-4 | 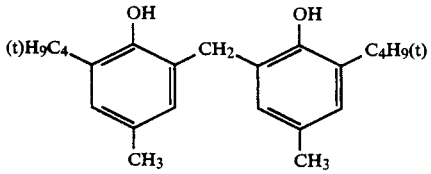 | |
| UV-1 | 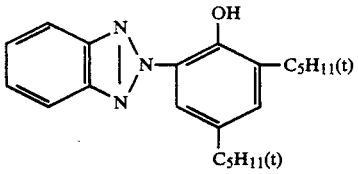 | |
| UV-2 | 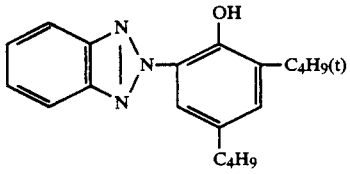 | |

TABLE 1-continued

| Layer | Constitution | Amount ($g/m^2$) |
|---|---|---|
| AI-1 | 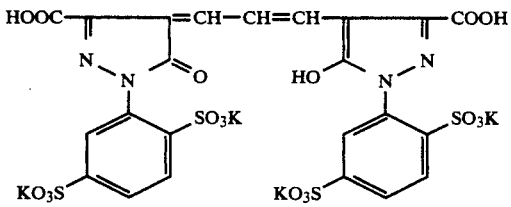 | |
| AI-2 | 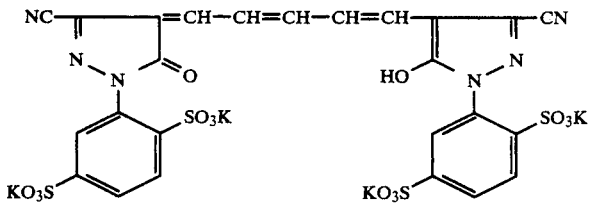 | |
| HB-1 | 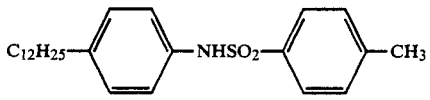 | |

Procedures for preparing Sample 1 were also repeated but changing the stabilizer (SB-1) and magenta coupler (MA) of the green-sensitive silver halide emulsion in the third layer as shown in Table 2, thus preparing Samples 2 to 17.

These samples were subjected to optical wedge exposure to green light using a sensitometer (KS-7 Type, manufactured by Konica Corporation), and processing was carried out according to the following processing steps.

| Processing step | Temperature | Time |
|---|---|---|
| Color developing | 35.0 ± 0.3° C. | 45 seconds |
| Bleach-fixing | 35.0 ± 0.5° C. | 45 seconds |
| Stabilizing | 30 to 34° C. | 90 seconds |
| Drying | 60 to 80° C. | 60 seconds |

Color developing solution

| | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Brightening agent (a 4,4'-diaminostilbenedisulfonic acid derivative) | 1.0 g |
| Potassium carbonate | 27 g |
| Made up to 1 l in total by adding water, and adjusted to pH = 10.10. | |

Bleach-fixing solution

Containing in 1 l of a bleach-fixing solution;

| | |
|---|---|
| Ferric ammonium ethylenediaminetetraacetate dihydrate | 60 g |
| Ethylenediaminetetraacetic acid | 3 g |
| Ammonium thiosulfate (an aqueous 70% solution) | 100 ml |

-continued

| | |
|---|---|
| Ammonium sulfite (an aqueous 40% solution) | 27.5 ml |

Adjusted to pH=5.7 using potassium carbonate or glacial acetic acid.

Stabilizing solution

Containing in 1 l of a stabilizing solution;

| | |
|---|---|
| 5-Chloro-2-methyl-4-isothiazolin-3-on | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (an aqueous 20% solution) | 3.0 g |
| Ammonium sulfite | 3.0 g |
| Brightening agent (a 4,4'-diaminostilbenedisulfonic acid derivative) | 1.5 g |

Adjusted to pH=7.0 using sulfuric acid or potassium hydroxide.

Measurement of tones and bleach-fixing solution inclusion resistance tests were carried out in the following manner.

Measurement of tones

Spectral absorption spectra of the magenta color samples were measured using a color analyzer 607 Type (manufactured by Hitachi Ltd.). Maximum absorption wavelengths (λmax) of the visible absorption areas, measured there, were used as standards of tones.

Visual evaluation was also made.

Bleach-fixing solution inclusion resistance tests

A color developing solution was prepared in which 1.0 ml of the above bleach-fixing solution was added per liter of the above color developing solution.

Using this color developing solution, processing was carried out following the above processing steps, and the bleach-fixing solution inclusion resistance was evaluated based on the difference ($\Delta D_{min}{}^{G}$) between the green-light reflection density at unexposed areas (white areas) observed here and the green-light reflection density at unexposed areas observed when the processing was carried out using the developing solution into which the above bleach-fixing solution was not included.

Results obtained are shown in Table 2.

TABLE 2

| Sample No. | Stabilizer for green-sensitive emulsion | Magenta coupler | Bleach-fixing solution inclusion resistance ($\Delta D_{min}^{G}$) | Tone λmax | Tone Visual observation |
|---|---|---|---|---|---|
| 1 (X) | SB-1 | MA | 0.13 | 537 | Bluish magenta |
| 2 (X) | S-11 | MA | 0.13 | 537 | Bluish magenta |
| 3 (X) | S-14 | MA | 0.13 | 537 | Bluish magenta |
| 4 (X) | SB-1 | MB | 0.05 | 530 | Yellowih magenta |
| 5 (X) | S-11 | MB | 0.05 | 530 | Yellowish magenta |
| 6 (X) | S-14 | MB | 0.06 | 530 | Yellowish magenta |
| 7 (X) | SB-1 | MC | 0.04 | 531 | Yellowish magenta |
| 8 (X) | S-11 | MC | 0.05 | 531 | Yellowish magenta |
| 9 (X) | S-14 | MC | 0.04 | 531 | Yellowish magenta |
| 10 (X) | SB-1 | M-2 | 0.06 | 534 | Good magenta |
| 11 (Y) | S-3 | M-2 | 0.03 | 534 | Good magenta |
| 12 (Y) | S-9 | M-2 | 0.03 | 534 | Good magenta |
| 13 (Y) | S-11 | M-2 | 0.02 | 534 | Good magenta |
| 14 (Y) | S-21 | M-2 | 0.02 | 534 | Good magenta |
| 15 (Y) | S-14 | M-3 | 0.01 | 533 | Good magenta |
| 16 (Y) | S-14 | M-4 | 0.02 | 534 | Good magenta |
| 17 (Y) | S-14 | M-7 | 0.01 | 533 | Good magenta |

MB

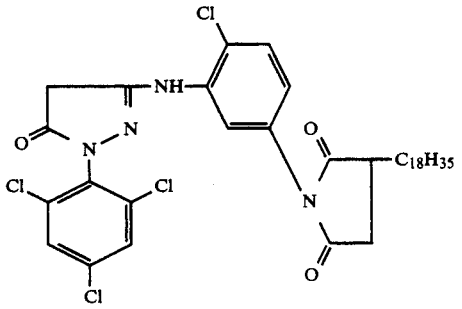

MC

TABLE 2-continued

| Sample No. | Stabilizer for green-sensitive emulsion | Magenta coupler | Bleach-fixing solution inclusion resistance ($\Delta D_{min}^{G}$) | Tone λmax | Tone Visual observation |
|---|---|---|---|---|---|
| | | 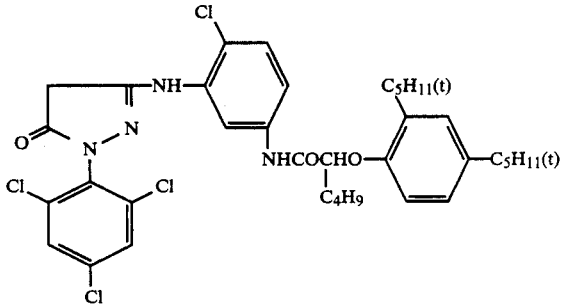 | | | |

X: Comparative Example
Y: Present invention

As will be evident from Table 2, use of the comparative coupler MA results in a great increase in the fog caused by the inclusion of the bleach-fixing solution, and this can not be repaired even with use of the stabilizer of the green-sensitive emulsion according to the present invention.

Use of the comparative couplers MB and MC can bring about a decrease in the fog ascribable to the inclusion of the bleach-fixing solution, but results in tones of yellowish magenta.

Use of the coupler of the present invention particularly enables suppression of the fog when used in combination with the stabilizer of the green-sensitive emulsion of the present invention. Such effect was unexpected from the comparative couplers.

There were also seen good tones.

EXAMPLE 2

On a cellulose acetate film support applied with subbing, the layers having the following composition were provided in the prescribed order from the substrate side to prepare Sample 18 coated with emulsion layers.

Layer 1: Anti-halation layer
Containing 0.2 g/m$^2$ of black colloidal silver, and 1.7 g/m$^2$ of gelatin.
Layer thickness: 1.25 μm Layer 2: Intermediate layer
Containing 1.0 g/m$^2$ of gelatin.
Layer thickness: 0.75 μm Layer 3: Red-sensitive low-speed silver halide emulsion layer
Containing 1.6 g/m$^2$ of a core/shell red-sensitive low-speed silver iodobromide emulsion comprised of 10 mol % of the core and 2 mol % of the shell, containing 5 mol % of silver iodide in average, and having an average grain size of 0.5 μm; 1.7 g/m$^2$ of gelatin; 0.075 mol of the following coupler C-3 per mol of silver; 0.005 mol of the following coupler CC-1 per mol of silver; and 0.004 mol of the following DIR compound D-1 per mol of silver.
Layer thickness: 2.75 μm Layer 4: Red-sensitive high-speed silver halide emulsion layer
Containing 1.1 g/m$^2$ of a red-sensitive high-speed silver iodobromide emulsion containing 5.5 mol % of silver iodide, and having an average grain size of 0.8 μm; 1.0 g/m² of gelatin; 0.004 mol of the following coupler C-3 per mol of silver; 0.013 mol of the following coupler C-4 per mol of silver; 0.003 mol of the following coupler CC-1 per mol of silver; and 0.002 mol of the following DIR compound D-1 per mol of silver.

Layer thickness: 1.2 μm

Layer 5: Intermediate layer

Containing 0.6 g/m² of gelatin.

Layer thickness: 0.45 μm

Layer 6: Green-sensitive low-speed silver halide emulsion layer

Containing 1.3 g/m² of a core/shell green-sensitive low-speed silver iodobromide emulsion comprised of 10 mol % of the core and 2 mol % of the shell, containing 5 mol % of silver iodide in average, and having an average grain size of 0.5 μm; 1.6 g/m² of gelatin; 0.055 mol of the following coupler MA per mol of silver; 0.014 mol of the following coupler CM-1 per mol of silver; and 0.004 mol of the following DIR compound D-2 per mol of silver.

Layer thickness: 2.7 μm

Layer 7: Green-sensitive high-speed silver halide emulsion layer

Containing 1.0 g/m² of a green-sensitive high-speed silver iodobromide emulsion containing 5.5 mol % of silver iodide, and having an average grain size of 0.8 μm; 0.8 g/m² of gelatin; 0.016 mol of the following coupler MA per mol of silver; 0.005 mol of the following coupler CM-1 per mol of silver; and 0.002 mol of the following DIR compound D-2 per mol of silver.

Layer thickness: 1.3 μm

Layer 8: Intermediate layer

Containing 0.6 g/m² of gelatin.

Layer thickness: 0.45 μm

Layer 9: Yellow filter layer

Containing 0.1 g/m² of yellow colloidal silver, 0.7 g/m² of gelatin, and 0.06 g/m² of an anti-stain agent HQ-1. (HQ-1 was added in the form of an emulsification dispersion.)

Layer thickness: 0.6 μm

Layer 10: Blue-sensitive low-speed silver halide emulsion layer

Containing 0.5 g/m² of a core/shell blue-sensitive low-speed silver iodobromide emulsion comprised of 10 mol % of the core and 2 mol % of the shell, containing 5 mol % of silver iodide in average, and having an average grain size of 0.5 μm; 2.0 g/m² of gelatin; and 0.34 mol of the following coupler Y-2 per mol of silver.

Layer thickness: 3.1 μm

Layer 11: Blue-sensitive high-speed silver halide emulsion layer

Containing 0.5 g/m² of a blue-sensitive high-speed silver iodobromide emulsion containing 7 mol % of silver iodide, and having an average grain size of 0.8 μm; 1.2 g/m² of gelatin; and 0.10 mol of a coupler Y-2 per mol of silver.

Layer thickness: 1.4 μm

Layer 12: Protective colloid layer

Containing 2.0 g/m² of gelatin.

Layer thickness: 1.5 μm.

In Sample 18 (Comparative Example), diisodecylphthalate was used as the high-boiling organic solvent in each layer.

The magenta coupler MA of the green-sensitive emulsion layer and the stabilizer used in adjusting the green-sensitive emulsion were changed as shown in Table 3, thus preparing Samples 19 to 27.

In preparing the samples, the following materials were used.

MA, HQ-1: The same as Example 1

Coupler C-3

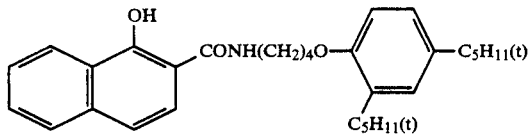

Coupler C-4

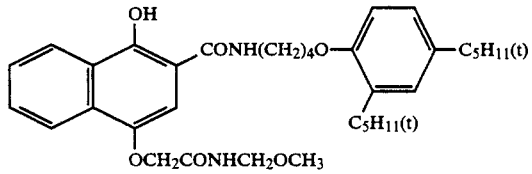

-continued
Coupler CC-1
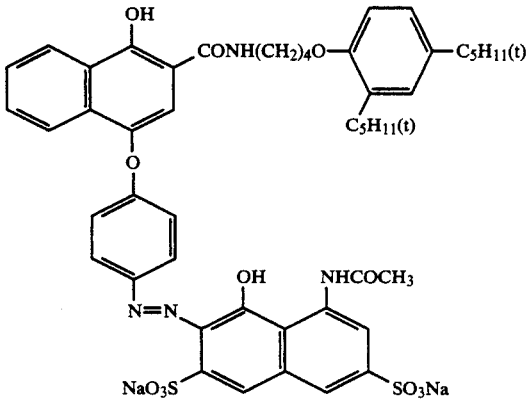
Coupler CM-1
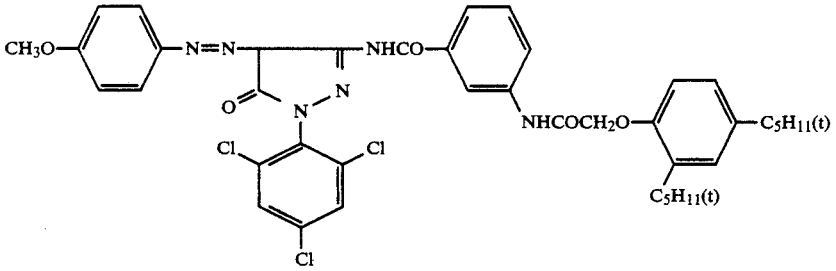
DIR Compound D-1
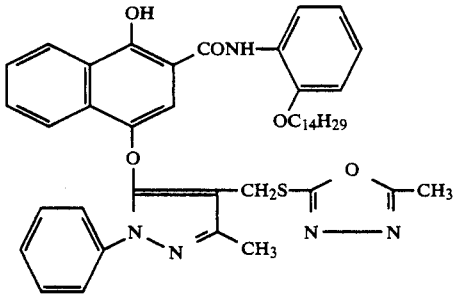
DIR Compound D-2
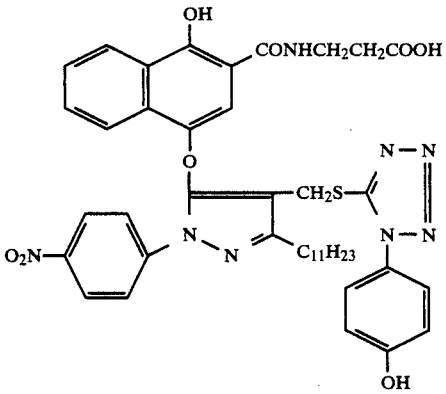

-continued

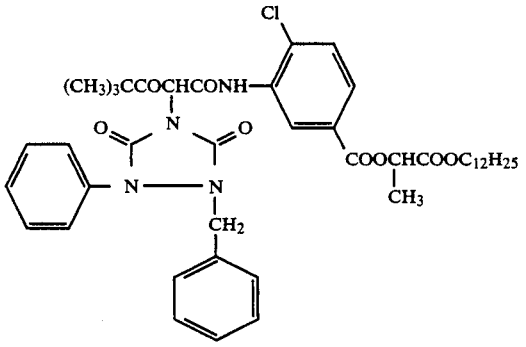

Y-2

Test pieces (3.5 cm×14 cm) of these were each brought into close contact with a transparent square wave chart, which was subjected to exposure to green light, followed by processing according to the following processing steps to obtain samples having dye images.

| Processing steps (38° C.) | Processing time |
|---|---|
| Color developing | 3 minutes 15 seconds |
| Bleaching | 6 minutes 30 seconds |
| Washing | 3 minutes 15 seconds |
| Fixing | 6 minutes 30 seconds |
| Washing | 3 minutes 15 seconds |
| Stabilizing bath | 1 minutes 30 seconds |

In the respective processing steps, the processing solutions used had the following composition.

Color developing solution

Containing in 1 l of a color developing solution;

| | |
|---|---|
| 4-Amino-3-methyl-N-ethyl-N-(β-hydroxyethyl)aniline sulfate | 4.75 g |
| Sodium sulfite anhydride | 4.25 g |
| Hydroxylamine ½ sulfate | 2.0 g |
| Potassium carbonate anhydride | 37.5 g |
| Sodium bromide | 1.3 g |
| Trisodium nitrilotriacetate (monohydrate) | 2.5 g |
| Potassium hydroxide | 1.0 g |

Adjusted to pH 10.0.

Bleaching solution

Containing in 1 l of a bleaching solution;

| | |
|---|---|
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |

Adjusted to pH 6.0.

Fixing solution

Containing in 1 l of a fixing solution;

| | |
|---|---|
| Aqueous 50% ammonium thiosulfate solution | 162 ml |
| Sodium sulfite anhydride | 12.4 ml |

Adjusted to pH 6.5.

Stabilizing solution

Containing in 1 l of a stabilizing solution;

| | |
|---|---|
| Aqueous 37% formalin solution | 5.0 ml |
| Konidax (a product of Konica Corporation) | 7.5 ml |

On the respective color images obtained in this way, their bleaching solution inclusion resistance and transmission spectral absorption characteristics were measured in the same manner as Example 1.

Results obtained are shown in Table 3.

TABLE 3

| Sample No. | Stabilizer for green-sensitive emulsion | Magenta coupler | Bleach-fixing solution inclusion resistance ($\Delta D^G_{min}$) | Tone λmax | Tone Visual observation |
|---|---|---|---|---|---|
| 18 (X) | — | MA | 0.19 | 537 | Bluish magenta |
| 19 (X) | SB-1 | MA | 0.14 | 537 | Bluish magenta |
| 20 (X) | S-14 | MA | O.14 | 537 | Bluish magenta |
| 21 (X) | — | MB | 0.14 | 530 | Yellowish magenta |
| 22 (X) | SB-1 | MB | 0.11 | 530 | Yellowish magenta |
| 23 (X) | S-14 | MB | 0.10 | 530 | Yellowish magenta |
| 24 (X) | — | M-2 | 0.09 | 534 | Magenta |
| 25 (X) | SB-1 | M-2 | 0.09 | 534 | " |
| 26 (Y) | S-14 | M-2 | 0.05 | 534 | " |
| 27 (Y) | S-21 | M-2 | 0.05 | 534 | " |

X: Comparative Example
Y: Present invention
MB: The same as Example 1.

As will be evident from Table 3, in the samples of the present invention, the tone of magenta is not yellowish, and also the fog ascribable to the inclusion of bleaching solution can be suppressed.

EXAMPLE 3

On a paper support coated with polyethylene on its both sides, the following first to twelfth layers were provided to prepare a color reversal light-sensitive material Sample 28. The coating weight for each component is indicated by g/m². However, that for silver halide is indicated by the coating weight calculated as silver.

First layer: (Gelatin layer)

-continued

| | |
|---|---|
| Gelatin | 1.40 |
| Second layer: (Anti-halation layer) | |
| Black colloidal silver | 0.10 |
| Gelatin | 0.60 |
| Third layer: (First red-sensitive layer) | |
| Cyan coupler (C-2) | 0.14 |
| Cyan coupler (C-1) | 0.07 |
| High-boiling solvent (DBP) | 0.06 |
| AgBrI spectrally sensitized with red sensitizing dyes (S-1, S-2) (AgI: 3.0 mol %; average grain size: | 0.4 |
| μm) | 0.14 |
| Gelatin | 1.0 |
| Fourth layer: (Second red-sensitive layer) | |
| Cyan coupler (C-2) | 0.20 |
| Cyan coupler (C-1) | 0.10 |
| High-boiling solvent (DBP) | 0.10 |
| AgBrI spectrally sensitized with red sensitizing dyes (S-1, S-2) (AgI: 3.0 mol %; average grain size: | 0.8 |
| μm) | 0.16 |
| Gelatin | 1.0 |
| Fifth layer: (First intermediate layer) | |
| Gelatin | 1.0 |
| Anti-stain agent (HQ-1) | 0.08 |
| Sixth layer: (First green-sensitive layer) | |
| Magenta coupler (MA) | 0.14 |
| High-boiling solvent (TCP) | 0.15 |
| AgBrI spectrally sensitized with a green sensitizing dye (S-3) (AgI: 3.0 mol %; average grain size: | 0.4 |
| μm) | 0.15 |
| Gelatin | 1.0 |
| Seventh layer: (Second green-sensitive layer) | |
| Magenta coupler (MA) | 0.14 |
| High-boiling solvent (TCP) | 0.15 |
| AgBrI spectrally sensitized with a green sensitizing dye (S-3) (AgI: 3.0 mol %; average grain size: | 0.7 |
| μm) | 0.15 |
| Gelatin | 1.0 |
| Eighth layer: (Second intermediate layer) | |
| Yellow colloidal silver | 0.15 |
| Anti-stain agent (HQ-1) | 0.08 |
| Gelatin | 1.0 |
| Ninth layer: (First blue-sensitive layer) | |
| Yellow coupler (Y-3) | 0.40 |
| High-boiling solvent (DBP) | 0.10 |
| AgBrI spectrally sensitized with a blue sensitizing dye (S-4) (AgI: 3.0 mol %; average grain size: | 0.4 |
| μm) | 0.15 |
| Gelatin | 0.70 |
| Tenth layer: (Second blue-sensitive layer) | |
| Yellow coupler (Y-3) | 0.80 |
| High-boiling solvent (TCP) | 0.20 |
| AgBrI spectrally sensitized with a blue sensitizing dye (S-4) (AgI: 3.0 mol %; average grain size: | 0.8 |
| μm) | 0.20 |
| Gelatin | 1.3 |
| Eleventh layer: (Ultraviolet absorbing layer) | |
| Ultraviolet absorbent (UV-1) | 0.2 |
| Ultraviolet absorbent (UV-2) | 0.2 |
| Ultraviolet absorbent (UV-3) | 0.2 |
| Ultraviolet absorbent (UV-4) | 0.2 |
| Gelatin | 2.0 |
| Twelfth layer: (Protective layer) | |
| Gelatin | 1.0 |

In addition to the above, however, surface active agents, hardening agents and anti-irradiation dyes are contained.

C-1, C-2, HQ-1, MA, UV-1, UV-2: The same as Example 1.
DBP: Dibutylphthalate
TCP: Tricresyl phosphate

Y-3

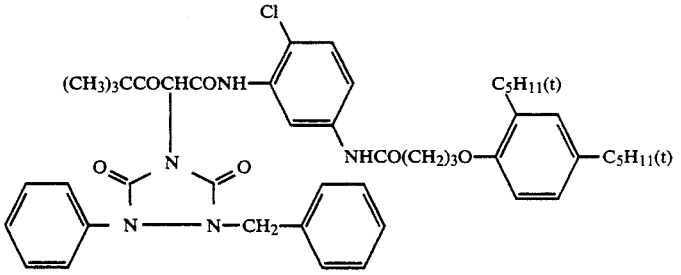

S-1

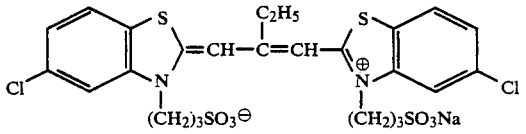

S-2

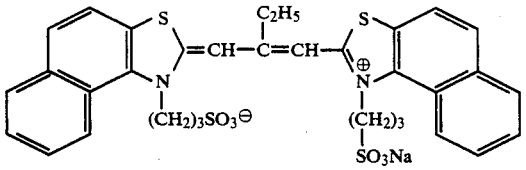

S-3

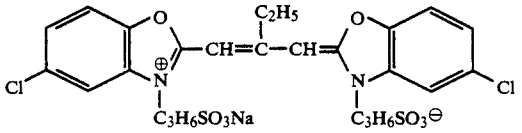

-continued

S-4

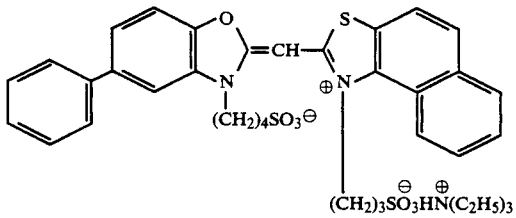

UV-3

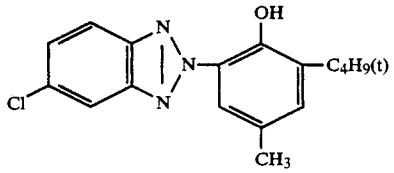

UV-4

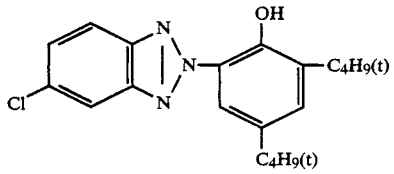

The procedures for preparing Sample 28 were repeated but changing as shown in Table 4 the combination of the magenta couplers and the stabilizers used in adjusting the green-sensitive emulsions in the sixth and seven layers, thus preparing Samples 29 to 37.

The above samples were each subjected to magenta exposure through an optical wedge by using a color filter CC-90M, available from Eastman Kodak Co., followed by the following processing. The fog resistance tests were also carried out in the same manner as Example 1, using the developing solution into which the bleach-fixing solution was included.

| | |
|---|---|
| First developing (monochrome developing) | 1 minutes 15 seconds at 38° C. |
| Washing | 1 minutes 30 seconds |
| Light fogging | not less than 100 lux, not less than 1 second |
| Second developing (color developing) | 2 minutes 15 seconds at 38° C. |
| Washing | 45 seconds |
| Bleach-fixing | 2 minutes at 38° C. |
| Washing | 2 minutes 15 seconds |

First developing solution

Containing in 1 l of a first developing solution;

| | |
|---|---|
| Potassium sulfite | 3.0 g |
| Sodium thiocyanate | 1.0 g |
| Sodium bromide | 2.4 g |
| Potassium iodide | 8.0 mg |
| Potassium hydroxide (48%) | 6.2 ml |
| Potassium carbonate | 14 g |
| Sodium hydrogencarbonate | 12 g |
| 1-Phenyl-4-methyl-4-hydroxymethyl-3-pyrazolidone | 1.5 g |
| Hydroquinone monosulfonate (pH 9.65) | 23.3 g |

Color developing solution

Containing in 1 l of a color developing solution;

| | |
|---|---|
| Benzyl alcohol | 14.6 ml |
| Ethylene glycol | 12.6 ml |
| Potassium carbonate (anhydride) | 26 g |
| Potassium hydroxide | 1.4 g |
| Sodium sulfite | 1.6 g |
| 3,6-Dithiaoctane-1,8-diol | 0.24 g |
| Hydroxylamine sulfate | 2.6 g |
| 4-N-ethyl-N-β-(methanesulfonamidoethyl)-2-methyl-p-phenylenediamine sesquisulfate | 5.0 g |

Bleach-fixing solution

Containing in 1 l of a bleach-fixing solution;

| | |
|---|---|
| A 1.56 mol solution of ferric ammonium ethylenediaminetetraacetate | 115 ml |
| Sodium metabisulfite | 15.4 g |
| Ammonium thiosulfate (58%) | 126 ml |
| 1,2,4-Triazole-3-thiol (pH = 6.5) | 0.4 g |

On these samples, the bleach-fixing solution inclusion fogging and tone were evaluated in the same manner as Example 1.

Results obtained are shown in Table 4.

TABLE 4

| Sample No. | Stabilizer for green-sensitive emulsion | Magenta coupler | Bleach-fixing solution inclusion resistance ($\Delta D_{min}{}^{G}$) | Tone λmax | Tone Visual observation |
|---|---|---|---|---|---|
| 28 (X) | — | MA | 0.21 | 537 | Bluish magenta |
| 29 (X) | SB-1 | MA | 0.15 | 537 | Bluish magenta |
| 30 (X) | S-3 | MA | 0.14 | 537 | Bluish magenta |
| 31 (X) | — | MB | 0.13 | 530 | Yellowish magenta |
| 32 (X) | SB-1 | MB | 0.10 | 530 | Yellowish magenta |
| 33 (X) | S-3 | MB | 0.10 | 530 | Yellowish |

TABLE 4-continued

| Sample No. | Stabilizer for green-sensitive emulsion | Magenta coupler | Bleach-fixing solution inclusion resistance ($\Delta D_{min}{}^{G}$) | Tone λmax | Tone Visual observation |
|---|---|---|---|---|---|
| 34 (X) | — | M-2 | 0.13 | 534 | magenta Good |
| 35 (X) | SB-1 | M-2 | 0.09 | 534 | magenta Good |
| 36 (Y) | S-3 | M-2 | 0.05 | 534 | magenta Good |
| 37 (Y) | S-21 | M-2 | 0.06 | 534 | magenta Good |

X: Comparative Example
Y: Present invention
SB-1, MB: The same as Example 1.

As will be evident from Table 4, the combination in accordance with the present invention made it able to obtain images particularly suffering only a small fog ascribable to the inclusion of the bleach-fixing solution and also having a good tone.

EXAMPLE 4

In a mixed solution comprising 80 ml of diisodecylphthalate and 200 ml of ethyl acetate, 50 g of a magenta coupler (MA) was dissolved, and the resulting solution was added in an aqueous 5% gelatin solution containing a dispersing agent, which were then dispersed using a homogenizer. The resulting dispersion was made up to 1,500 ml and thereafter kept at temperature of 35° C. This dispersion was added in 1,000 ml of an aqueous 3% gelatin solution for use in coating, to which 400 g of a green-sensitive silver chlorobromide emulsion containing 80 mol % of silver bromide, with a silver weight of 30 g, was further added, thus preparing a coating solution for a third layer.

Also similarly prepared were coating solutions for other layers, which were successively provided by coating on a polyethylene-coated paper support having been subjected to corona discharge treatment (titanium oxide and a bluing agent were contained in the polyethylene on the emulsion layer side), to prepare a color light-sensitive material having the following layers in the following order.

First layer: Blue-sensitive emulsion layer
Coated to give coating weights of 8 mg/dm$^2$ of a yellow coupler (Y-4), 3 mg/dm$^2$ of an anti-color-fading agent (ST-1), 3 mg/dm$^2$ of a blue-sensitive silver chlorobromide emulsion (containing 20 mol % of silver chloride and 80 mol % of silver bromide) in terms of silver, 3 mg/dm$^2$ of a high-boiling organic solvent (DNP), and 16 mg/dm$^2$ of gelatin.

Second layer: Intermediate layer
Coated to give coating weights of 0.45 mg/dm$^2$ of a hydroquinone derivative (HQ-1), 1 mg/dm$^2$ of a diaminostilbene brightening agent, and 4 mg/dm$^2$ of gelatin.

Third layer: Green-sensitive emulsion layer
Coated to give coating weights of 4 mg/dm$^2$ of a magenta coupler (MA), 2 mg/dm$^2$ of a green-sensitive silver chlorobromide emulsion (containing 20 mol % of silver chloride and 80 mol % of silver bromide) in terms of silver, 4 mg/dm$^2$ of a high-boiling organic solvent (DIDP), and 16 mg/dm$^2$ of gelatin.

Fourth layer: Intermediate layer
Coated to give coating weights of 3 mg/dm$^2$ of an ultraviolet absorbent (UV-1), 3 mg/dm$^2$ of the same (UV-2), 4 mg/dm$^2$ of DNP, 0.45 mg/dm$^2$ of a hydroquinone derivative (HQ-2), 14 mg/dm$^2$ of gelatin, and a trace amount of an oil-soluble bluing dye.

Fifth layer: Red-sensitive emulsion layer
Coated to give coating weights of 2 mg/dm$^2$ of a cyan coupler (C-1), 2 mg/dm$^2$ of the same (C-2), 2 mg/dm$^2$ of an anti-color-fading agent (ST-1), 4 mg/dm$^2$ of DOP, 3 mg/dm$^2$ of a red-sensitive silver chlorobromide emulsion (containing 20 mol % of silver chloride and 80 mol % of silver bromide) in terms of silver, and 3 mg/dm$^2$ of gelatin.

Sixth layer: Intermediate layer
Coated to give coating weights of 4 mg/dm$^2$ of an ultraviolet absorbent (UV-5), 0.2 mg/dm$^2$ of HQ-1, 1 mg/dm$^2$ of polyvinyl pyrrolidone, 2 mg/dm$^2$ of DNP, and 6 mg/dm$^2$ of gelatin.

Seventh layer: Protective layer
Coated to give a coating weight of 9 mg/dm$^2$ of gelatin.

Also prepared were Samples 39 to 49 by changing the magenta coupler (MA) in the third layer, the anti-color fading agents and the stabilizer used in the green-sensitive emulsion, as shown in Table 5.

HQ-1, MA, DIDP, UV-1, UV-2, DNP, C-1, C-2, ST-1, DOP:
The same as Example 1.

HQ-2

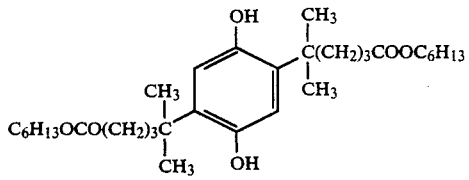

UV-5

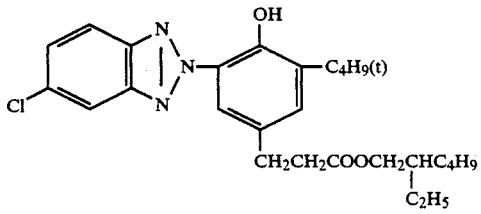

-continued

Y-4

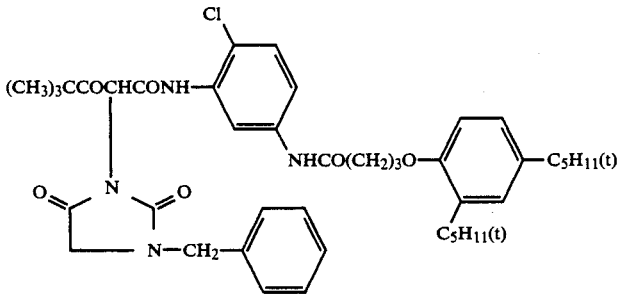

The resulting samples were each subjected to wedge exposure to green light using a sensitometer (KS-7 Type, manufactured by Konica Corporation), followed by the following processing.

| Processing steps | Processing temperature | Processing time |
|---|---|---|
| Color developing | 32.8° C. | 3 min. 30 sec |
| Bleach-fixing | 32.8° C. | 1 min. 30 sec |
| Stabilizing bath | 32.8° C. | 3 min. 30 sec |

Color developing solution

Containing in 1 l of a color developing solution;

| | |
|---|---|
| N-ethyl-N-β-methanesulfonamidoethyl-3-methyl-4-aminoaniline sulfate | 4.0 g |
| Hyroxylamine sulfate | 2.0 g |
| Potassium carbonate | 25.0 g |
| Sodium chloride | 0.1 g |
| Sodium bromide | 0.2 g |
| Sodium sulfite anhydride | 2.0 g |
| Benzyl alcohol | 10.0 ml |
| Polyethylene glycol (average degree of polymerization: 400) | 3.0 ml |

Adjusted to pH 10.0 using sodium hydroxide.

Bleach-fixing solution

Containing in 1 l of a bleach-fixing solution;

| | |
|---|---|
| Ferric sodium ethylenediaminetetraacetate | 60.0 g |
| Sodium thiosulfate | 100.0 g |
| Sodium bisulfite | 20.0 g |
| Sodium metabisulfite | 5.0 g |

Adjusted to pH 7.0 using sulfuric acid.

Stabilizing bath

The same as Example 1.

The processing was carried out using an automatic processing machine in which the stabilizing is of a multistage countercurrent system. The tones of magenta color images of the resulting samples were measured and the bleach-fixing solution inclusion resistance was tested, in the same manner as Example 1.

Results obtained are shown in Table 5.

TABLE 5

| Sample No. | Stabilizer of green-sensitive emulsion | Magenta coupler | Anti-color fading agent | Bleach-fixing solution inclusion resistance ($\Delta D^{G}_{min}$) | Tone λmax | Tone Visual observation |
|---|---|---|---|---|---|---|
| 38 (X) | — | MA | — | 0.25 | 537 | Bluish magenta |
| 39 (X) | SB-1 | MA | — | 0.15 | 537 | Bluish magenta |
| 40 (X) | S-21 | MA | — | 0.14 | 537 | Bluish magneta |
| 41 (X) | — | MB | — | 0.13 | 530 | Yellowish magenta |
| 42 (X) | SB-1 | MB | — | 0.09 | 530 | Yellowish magenta |
| 43 (X) | S-21 | MB | — | 0.09 | 530 | Yellowish magenta |
| 44 (X) | — | M-2 | — | 0.13 | 534 | Good Magenta |
| 45 (X) | SB-1 | M-2 | — | 0.10 | 534 | Good Magenta |
| 46 (Y) | S-21 | M-2 | — | 0.04 | 534 | Good Magenta |
| 47 (Y) | S-21 | M-1 | — | 0.06 | 536 | Good Magenta |
| 48 (Y) | S-21 | M-2 | ST-3 ST-4 | 0.02 | 533 | Good |

X: Comparative Example
Y: Present invention
MB, SB-1, ST-3, ST-4: The same as Example 1; ST-3 was added in an amount of 1.5 mol per mol of coupler, and ST-4, 0.5 mol per mol of coupler.

As will be evident from Table 5, the samples of the present invention prevent generation of the fog caused when the bleaching solution is included into the developing solution, and show a good tone.

The fog resistance also becomes better when the anti-color-fading agent is used in combination.

The fog resistance was similarly improved also when S-21 was added in the second layer.

As having described above, the silver halide photographic light-sensitive material of the present invention exhibits the effect that it suffers less deterioration of the tone of magenta color images and prevents generation of the magenta fog caused when the bleaching solution is included into the developing solution.

What is claimed is:

1. A silver halide photographic light-sensitive material comprising a support having thereon a silver halide emulsion layer and a non-light-sensitive layer, wherein said silver halide emulsion layer contains at least one of the magenta couplers represented by the following Formula I, and at least one of said silver halide emulsion layer and said non-light-sensitive layer contains at least one of the compounds represented by the following Formula S:

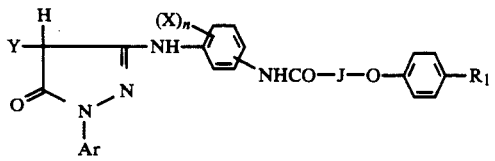

(I)

wherein Ar is an aryl group; Y is a hydrogen atom or a group capable of being split off upon reaction with the oxidation product of a color developing agent, X is a halogen atom, an alkoxy group or an alkyl group; $R_1$ is a straight or branched chain alkyl group having 1 to 20 carbon atoms; J is a straight or branched chain alkylene group; and n is an integer of 0 to 4, provided that the groups represented by X may be the same with or different from each other when n is 2 or more,

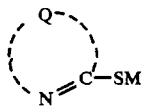

(S)

wherein Q is a group of atoms necessary to complete a five-or six-member heterocyclic ring which is allowed to be condensed with a benzene ring or a naphthalene ring; M is a hydrogen atom, an alkali metal atom or an ammonium group.

2. The material of claim 1, wherein said alkylene group represented by J is a metylene group substituted by an alkyl group having 1 to 20 carbon atoms.

3. The material of claim 2, wherein said alkylene group represented by J is a methylene group substituted by an alkyl group having 1 to 4 carbon atoms.

4. The material of claim 1, wherein said heterocyclic ring represented by Q is an imidazole ring, a tetrazole ring, a thiazole ring, an oxazole ring, a selenazole ring, a benzimidazole ring, a naphthoimidazole ring, a benzothiazole ring, a naphthothiazole ring, a benzoselenazole ring, a benzoxazole, a pyridine ring, a pyrimidine ring or a quinoline ring, said heterocyclic rings may have a substituent.

5. The material of claim 1, wherein said magenta coupler is contained in said silver halide emulsion layer in an amount of from $1\times10^{-3}$ mol to 1 mol per mol of silver halide.

6. The material of claim 5, wherein said magenta coupler is contained in said silver halide emulsion layer in an amount of from $1\times10^{-2}$ mol to $8\times10^{-1}$ mol per mol of silver halide.

7. The material of claim 1, wherein said compound represented by Formula S is added to a silver halide emulsion contained in said silver halide emulsion layer at the course of chemical ripening, at the time that chemical ripening is completed or in the time of later than completion of chemical ripening and not later than coating of said silver halide emulsion.

8. The material of claim 1, wherein said compound represented by Formula S is contained in said silver halide emulsion layer in an amount of from $1\times10^{-6}$ mol to $1\times10^{-1}$ mol per mol of silver halide.

9. The material of claim 8, wherein said compound is contained in said silver halide emulsion layer in an amount of from $1\times10^{-5}$ mol to $1\times10^{-2}$ mol per mol of silver halide.

10. The materila of claim 1, wherein a high-boiling organic solvent having a dielectric constant of not more than 6.5 is contained in said silver halide emulsion layer.

11. The material of claim 10, wherein said high-boiling organic solvent is a phthalic acid ester, a phospholic acid ester, an organic acid amide, a ketone or a carbon hydride.

12. The material of claim 11, wherein said high-boiling organic solvent is a dialkyl phthalate having an alkyl group including 9 or more carbon atoms.

13. The material of claim 1, wherein said silver halide emulsion layer comprises silver chlorobromide.

14. The material of claim 13, wherein said silver chlorobromide contains not less than 90 mol % of silver chloride.

15. The material of claim 14, wherein said silver chlorobromide contains not less than 99 mol % of silver chloride.

* * * * *